US008702404B2

(12) United States Patent
Cho et al.

(10) Patent No.: US 8,702,404 B2
(45) Date of Patent: Apr. 22, 2014

(54) AIR BLOWER FOR A FUEL CELL VEHICLE

(75) Inventors: Kyung Seok Cho, Daejeon (KR); Soon Ho Choi, Daejeon (KR); Hyun Sup Yang, Daejeon (KR); Cha You Lim, Daejeon (KR)

(73) Assignee: Halla Visteon Climate Control Corporation, Daejeon (KR)

( * ) Notice: Subject to any disclaimer, the term of this patent is extended or adjusted under 35 U.S.C. 154(b) by 262 days.

(21) Appl. No.: 12/956,148

(22) Filed: Nov. 30, 2010

(65) Prior Publication Data

US 2011/0135519 A1 Jun. 9, 2011

(30) Foreign Application Priority Data

Dec. 9, 2009 (KR) ..... 10-2009-0122040
Sep. 13, 2010 (KR) ..... 10-2010-0089483

(51) Int. Cl.
*F04B 39/06* (2006.01)
*F04B 35/04* (2006.01)

(52) U.S. Cl.
USPC ..... 417/423.8; 417/423.1; 417/423.14; 310/52; 310/64

(58) Field of Classification Search
USPC ..... 417/423.1, 423.8, 423.14; 310/52, 54, 310/64
See application file for complete search history.

(56) References Cited

U.S. PATENT DOCUMENTS

| | | | | |
|---|---|---|---|---|
| 3,725,706 | A * | 4/1973 | Lukens | 310/62 |
| 5,859,482 | A * | 1/1999 | Crowell et al. | 310/58 |
| 6,739,845 | B2 | 5/2004 | Woollenweber | |
| 7,354,669 | B2 | 4/2008 | Hobmeyr et al. | |
| 2003/0210992 | A1 * | 11/2003 | Huang et al. | 417/366 |
| 2004/0219401 | A1 * | 11/2004 | Hobmeyr et al. | 429/13 |
| 2009/0315416 | A1 * | 12/2009 | Tu | 310/54 |

FOREIGN PATENT DOCUMENTS

| | | |
|---|---|---|
| CN | 101517871 A | 9/2007 |
| JP | 2003-035153 | 2/2003 |
| KR | 10-0798084 B1 | 1/2008 |
| KR | 10-2009-0069617 | 7/2009 |
| KR | 10-2010-0037693 | 4/2010 |

OTHER PUBLICATIONS

Office action corresponding to Chinese patent application No. 20100580586.5 dated Sep. 24, 2012.

* cited by examiner

*Primary Examiner* — Peter J Bertheaud
*Assistant Examiner* — Dominick L Plakkoottam
(74) *Attorney, Agent, or Firm* — Lowe Hauptman & Ham, LLP

(57) ABSTRACT

Provided is an air blower for a fuel cell vehicle, and in particular, an air blower for a fuel cell vehicle having a cooling water passage formed in a motor case and an air flowing groove to increase cooling efficiency and reduce a shaft load to improve durability.

9 Claims, 7 Drawing Sheets

AIR BLOWER FOR A FUEL CELL VEHICLE

TECHNICAL FIELD

The present invention relates to an air blower for a fuel cell vehicle capable of improving cooling efficiency and durability.

BACKGROUND ART

Generally, a fuel cell vehicle driven with electric energy is consecutively generated by electrochemical reaction such as electrolysis reverse reaction of water generated when hydrogen supplied from a fuel supplier and oxygen in air supplied from an air supplier is supplied to a humidifier.

The fuel cell vehicle is configured to include a fuel cell stack generating electricity, a humidifier humidifying and supplying fuel and air in the fuel cell stack, a fuel supplier supplying hydrogen to the humidifier, an air supplier supplying air including oxygen to the humidifier, and a cooling module for cooling the fuel cell stack.

The air supplier is configured to include an air cleaner filtering foreign materials included in the air, an air blower compressing and supplying air filtered in the air cleaner, and a control box controlling the air blower. In this configuration, in order for the air blower to generate compressing air, a motor should be driven at high speed. As a result, a motor case should include a cooler. In addition, the control box includes its own cooler since a power device is heated while controlling the air blower.

SUMMARY OF DISCLOSURE

An object of the present invention is to provide an air blower for a fuel cell vehicle capable of uniformly cooling an entire motor by forming a cooling water passage, through which cooling water flows, in a motor case, thereby making it possible to further increase cooling efficiency.

Another object of the present invention is to provide an air blower for a fuel cell vehicle capable of cooling a bearing, a rotational shaft, a motor, or the like, by forming an air flowing groove at an area contacting an outer peripheral portion of a bearing and improving durability by reducing a shaft load generated by the difference in internal and external pressure.

Yet another object of the present invention is to provide an air blower for a fuel cell vehicle capable of increasing assembly and production efficiency by simplifying a structure and facilitating a maintenance process.

TECHNICAL SOLUTION

In one general aspect, an air blower 1000 for a fuel cell vehicle includes: a volute case 100; an impeller 200 equipped in the volute case 100 to compress air; a motor case 300 connected to the volute case 100 and having a motor receiving part 310 formed therein; a motor 400 provided in the motor case 300; and a cooling water passage 330 communicated along the circumference of the motor 400 in the motor case 300 and having cooling water flowing therein.

The inside of the motor case 300 may be provided with a module receiving part 320 in which an inverter control module 500 is separately provided from the motor receiving part 310 and the cooling water passage 330 may be formed between the motor receiving part 310 and the module receiving part 320.

The cooling water passage 330 may be formed of a pipe 330*a*.

At least one pipe 330*a* may be connected in a spiral shape along the circumference of the motor receiving part 310.

At least one pipe 330*a* may be formed in a cylindrical shape surrounding the circumference of the motor receiving part 310.

The cooling water passage 330 may be further provided with a pin 330*b* in at least one pipe 330*a*.

The cooling water passage 330 may communicate with the inlet pipe 331 into which the cooling water is introduced and the outlet pipe 332 from which the cooling water is discharged at one side of the motor case 300.

The motor case 300 may be made of a material having high heat conductivity in one body.

At least one pipe 330*a* may be made of a material having high corrosion resistance and high heat conductivity.

The motor 400 may have a stator 410, a rotational shaft 420 extendedly formed in a longitudinal direction to penetrate through the stator 410 and having the impeller 200 connected to one side thereof, a rotator 430 formed at an outer peripheral surface of the center of the rotational shaft 420, a first bearing 440 provided on one side connected to the impeller 200 of the rotational shaft 420, a second bearing 450 provided in the other side of the rotational shaft 420, a supporting member 460 fixed to the motor case 300 and having the other side of the rotational shaft 420, at which the second bearing 450 is provided, inserted into the central area thereof, and a cap 470 fixed to the supporting member 460 to surround the other side protruded from the rotational shaft 420 and the air blower 1000 may include a first air flowing part and a second air flowing part formed in a motor case 300 contacting the first bearing 440 and a supporting member 460 contacting a second bearing 450 to flow air along the rotational shaft 420.

The first air flowing part and the second air flowing part may each be configured to include a first air flowing groove 301 concavely formed in the motor case 300 and a second air flowing groove 461 concavely formed in the supporting member 460 and the first air flowing groove 301 may be formed in at least one along the circumference of the first bearing 440 and the second air flowing groove 461 may be formed in at least one along the circumference of the second bearing 450.

The cap 470 may be provided with a hollow communicating hole 471 and some air compressed by the impeller 200 is discharged to the outside through the first air flowing groove 301, an area between the rotator 430 and the stator 410, and the second air flowing groove 461 and the communicating hole 471.

ADVANTAGEOUS EFFECTS

According to the present invention, the air blower for a fuel cell vehicle forms the cooling water passage, through which the cooling water flows, in the motor case to uniformly cool the entire motor, thereby making it possible to increase the cooling efficiency.

Further, the structure of the air blower for a fuel cell vehicle of the present invention can be simplified and miniaturized by forming the motor and the inverter control module in the motor case and can improve the cooling efficiency of the entire blower by cooling the motor and the inverter control module using the cooling water passage.

In addition, the air blower for a fuel cell vehicle of the present invention can cool the motor by forming air flowing grooves in the area contacting bearings and improve the durability by reducing the shaft load using the air flow in air flowing grooves.

In addition, the present invention can increase the assembling and production efficiency by simplifying the structure and facilitate the maintenance process.

DETAILED DESCRIPTION OF MAIN ELEMENTS

Figure 1:
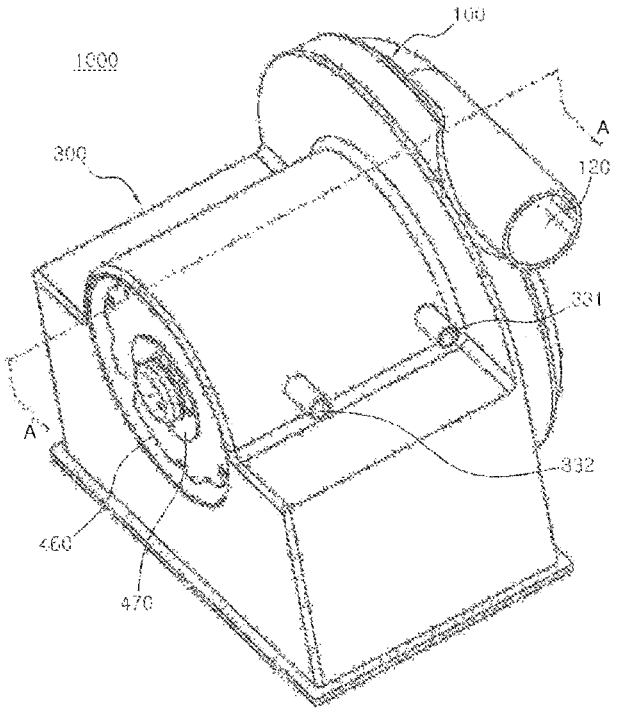
FIGS. 1 to 3 are a perspective view, an exploded perspective view, and a cross-sectional view of an air blower for a fuel cell vehicle according to the present invention.

1000: AIR BLOWER
100: VOLUTE CASE
110: AIR INLET
120: AIR OUTLET
130: AIR PASSAGE
200: IMPELLER
300: MOTOR CASE
301: FIRST AIR FLOWING GROOVE
310: MOTOR RECEIVING PART
320: MODULE RECEIVING PART
330: COOLING WATER PASSAGE
330A: PIPE
330B: PIN
331: INLET PIPE
332: OUTLET PIPE
400: MOTOR
410: STATOR
420: ROTATIONAL SHAFT
430: STATOR
440: FIRST BEARING
450: SECOND BEARING
460: SUPPORTING MEMBER
461: SECOND AIR FLOWING GROOVE
470: CAP
471: COMMUNICATING HOLE
500: INVERTER CONTROL MODULE
510: CIRCUIT SUBSTRATE
520: SWITCHING DEVICE

DESCRIPTION OF SPECIFIC EMBODIMENTS

Hereinafter, an air blower 1000 for a fuel cell vehicle according to the present invention will be described in detail with reference to the accompanying drawings.

The air blower 1000 for a fuel cell vehicle according to the present invention is configured to include a volute case 100, an impeller 200, a motor case 300, and a motor 400, wherein the motor case 300 is provided with a cooling water passage 330.

The shaft direction of the volute case 100 is provided with an air inlet 110 into which air is introduced and the radial direction thereof is provided with an air outlet 120 from which air is discharged. An air passage 130 connecting to the air inlet 110 and the air outlet 120 to move air is formed along the inner circumferential surface thereof.

The impeller 200 is equipped in the volute case 100 to compress air introduced through the air inlet 110. Most of the air introduced through the air inlet 110 is compressed by the impeller 200, and the air which is compressed is discharged to the outside along the air passage 130 and the air outlet 120.

In this case, some of the compressed air flow into the motor case 300 along the air flowing grooves 301 and 461 to cool components in the motor 400. The detailed structure thereof will be described below.

The motor case 300 is connected to the volute case 100 and includes a motor receiving part 310 in which the motor 400 is received.

Further, in order to miniaturize the air blower 1000 for a fuel cell vehicle according to the present invention, a module receiving part 320 including an inverter control module 500 may be formed in the motor case 300.

The module receiving part 320 is separately formed from the motor receiving part 310 and the inside thereof is provided with the inverter control module 500.

The inverter control module 500 has a structure in which a switching device 520 is mounted on a circuit substrate 510. The inverter control module 500 is provided in the airtight space (module receiving part 320) of the motor case 300, thereby making it possible to effectively shield an electromagnetic wave.

Although not shown in detail, an electromagnetic wave shielding filter and an electrolyte cap may be integrally configured in order to simplify the structure of the inverter control module 500.

In other words, in the air blower 1000 for a fuel cell vehicle the motor receiving part 310 including the motor 400 in the motor case 300 and the module receiving part 320 including the inverter control module 500 may be integrally formed.

The figures show an example where the motor case 300 is formed left and the volute case 100 is formed right. The motor 400 is provided in the space of the motor receiving part 310 but the rotational shaft 420 of the motor 400 is connected to the impeller 200 to rotate the impeller 200.

In this configuration, the air blower 1000 for a fuel cell vehicle of the present invention may be provided with a cooling water passage 330 through which cooling water flows in order to increase cooling efficiency.

The cooling water passage 330 is formed in the motor case 300 and is formed to have a predetermined space communicated along the circumference of the motor 400 to appropriately cool the motor 400, such that the cooling water flows in the space.

Presently, being communicated being along the circumference of the motor 400 may be interpreted as being communicated along the circumference of the motor receiving part 310 including the motor 400.

Figure 2:
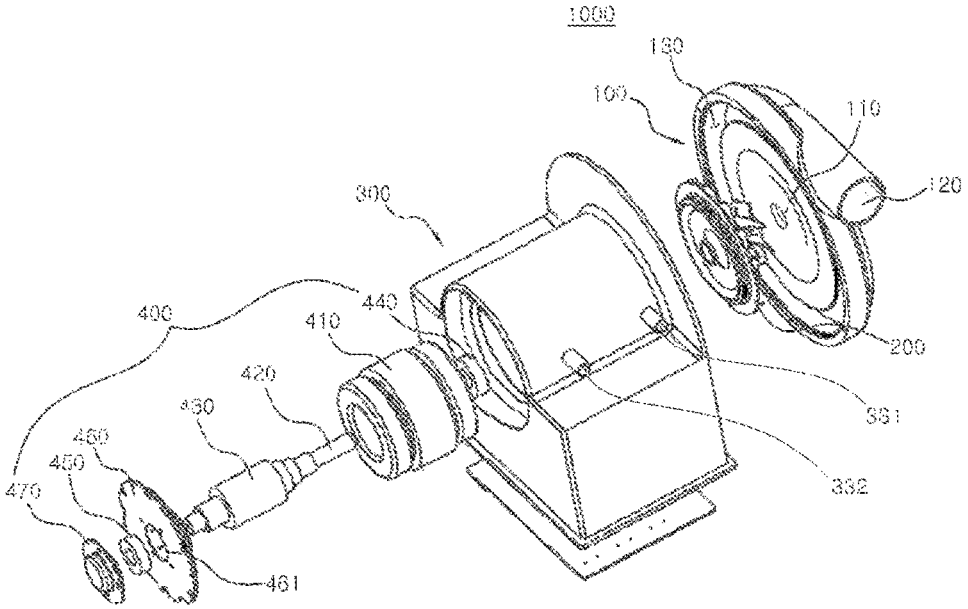

A cooling water passage 330 may be formed. FIGS. 1 and 2 show an example where one cooling water passage 330 communicates with each other in the entire area and the cooling water passage 330 is connected to an inlet pipe 331 into which the cooling water is introduced and an outlet pipe 332 from which the cooling water is discharged, respectively.

In this configuration, the inlet pipe 331 and the outlet pipe 332 may be formed in the motor case 300 and may be formed at the side of the motor case 300 or the rear of the motor case 300 in an air flowing direction.

First, the side of the motor case 300 means a circumferential portion of a direction vertical to a rotational shaft direction of the motor 400.

FIGS. 1 and 2 show an example where the inlet pipe 331 and the outlet pipe 332 are formed on the same side of the motor case 300.

In addition, the inlet pipe 331 or the outlet pipe 332 may be provided on the rear of the motor case 300 in an air flowing direction.

The rear in the air flowing direction means an opposite side (left in the FIGS. 1 and 2) where the impeller 200 is formed in a longitudinal direction of the rotational shaft 420. The opposite side where the impeller 200 is formed in the longitudinal direction of the rotational shaft 420 is likely to increase temperature as compared to a side where the impeller 200 is formed, such that it is easy to secure a space where the inlet pipe 331 and the outlet pipe 332 are formed.

As a result, the air blower 1000 for a fuel cell vehicle of the present invention can further increase the cooling performance by disposing the inlet pipe 331 or the outlet pipe 332 on an opposite side where the impeller 200 is formed.

Meanwhile, the cooling water passage 330 may be formed of a pipe 330*a*.

Figure 3:
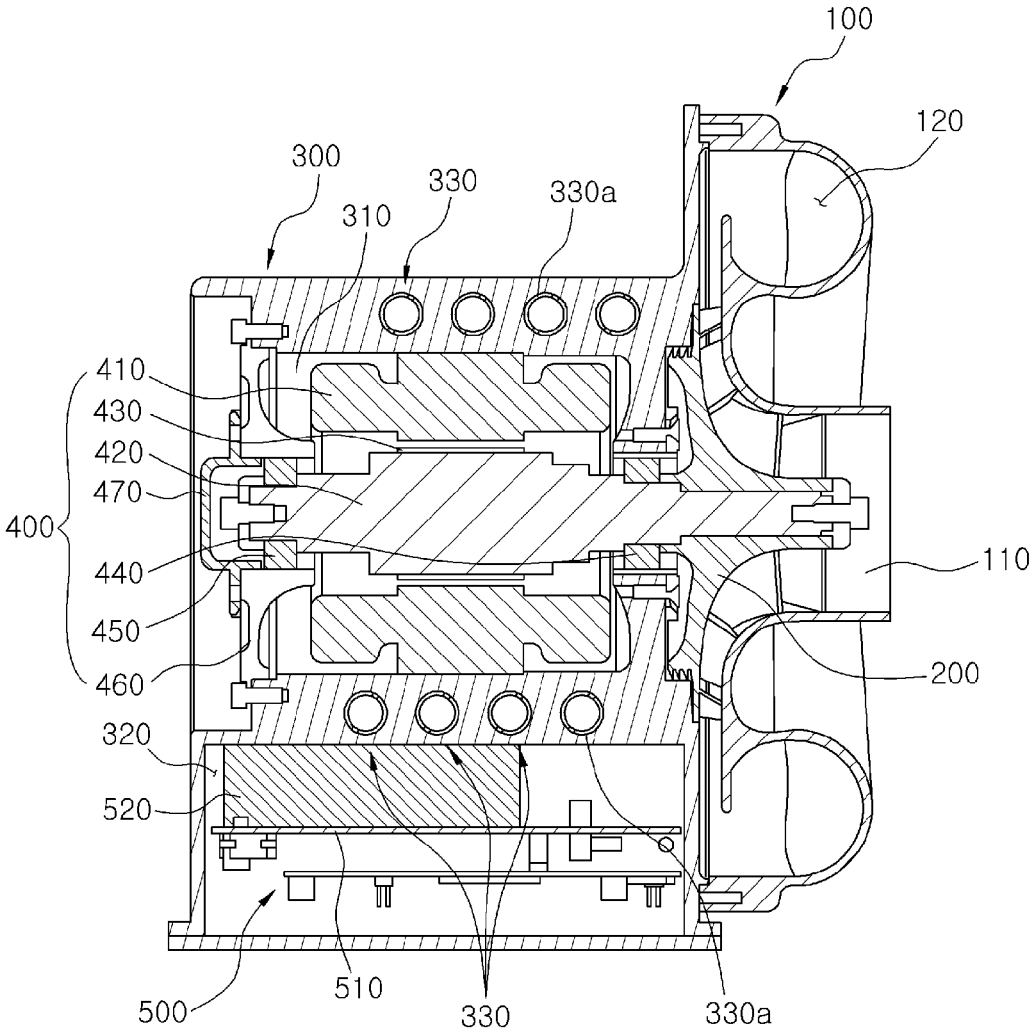

As shown in FIG. 3, at least one pipe 330*a* may be in a spiral shape along the circumference of the motor receiving part 310.

That is, the spiral cooling water passage 330 has a single passage and is formed to surround the motor case 300, thereby making it possible to smooth the flow of cooling water and improve the cooling effect.

Figure 4:
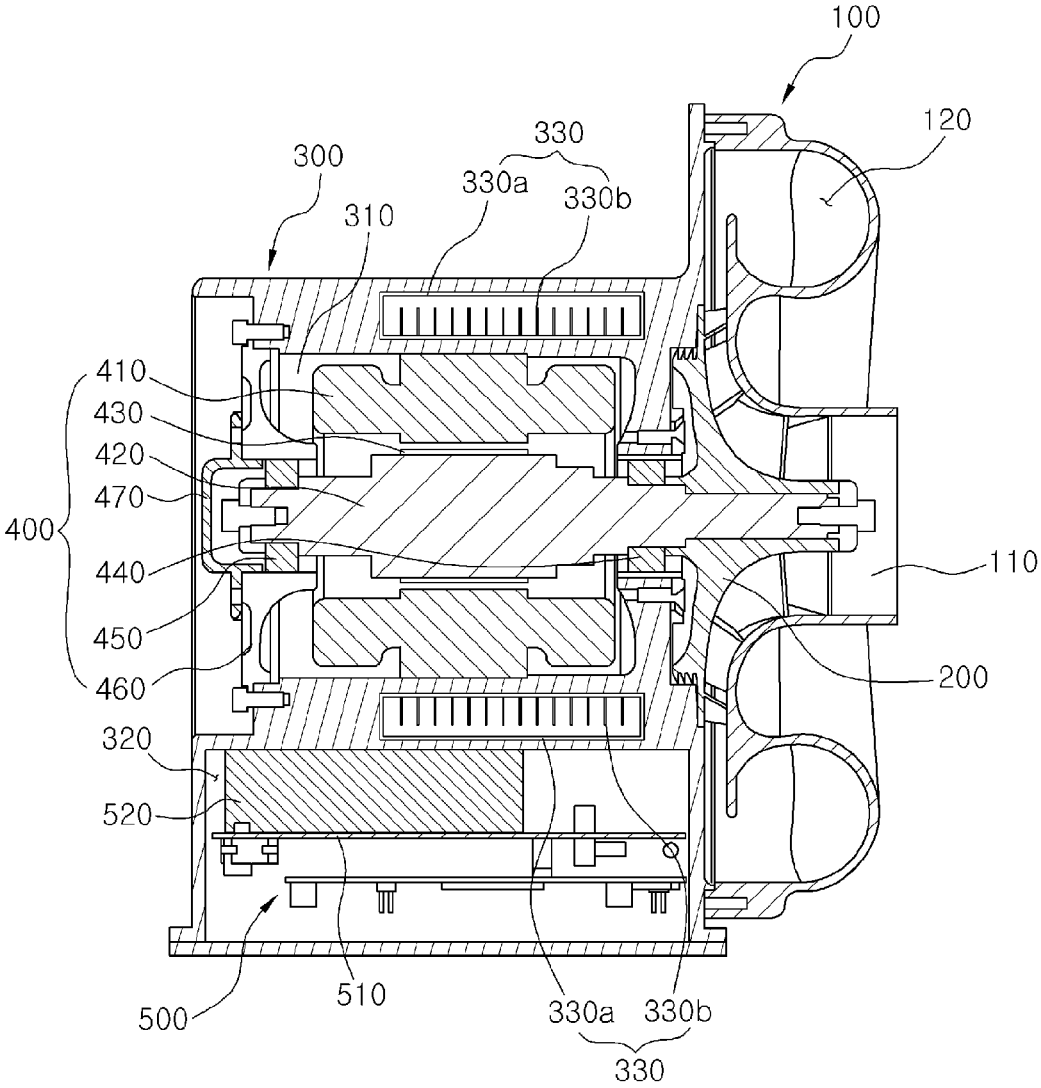
FIG. 4 is another cross-sectional view showing the air blower for a fuel cell vehicle.

In addition, as shown in FIG. 4, at least one pipe 330*a* may be formed in a cylindrical shape to surround the entire circumference of the motor receiving part 310.

FIG. 4 shows an example where the pin 330*b* is further formed in at least one pipe 330*a*. An example shown in FIG. 4 has an advantage of increasing the heat transfer performance and increasing the cooling performance accordingly.

Meanwhile, the cooling water passage 330 is formed between the motor receiving part 310 and the module receiving part 320 in a predetermined section, thereby making it possible to appropriately cool the motor 400 and the inverter control module 500 using the cooling water passage 330.

The motor case 300 is made of a high heat conductivity material in order to secure the sufficient cooling performance by using the cooling water flowing in the cooling water passage 330.

An example of a material having high heat conductivity may include aluminum or aluminum alloy.

Further, at least one pipe 330*a* forming the cooling water passage 330 is a space having the cooling water flowing therein and is made of a material having high heat conductivity and corrosion resistance.

In this case, an example of a material having high heat conductivity and corrosion resistance may include stainless steel, copper, and copper alloy.

In addition, in the air blower 1000 for a fuel cell vehicle of the present invention, air flowing grooves 301 and 461 are formed along the circumference of a first bearing 440 and a second bearing 450 in an area where the first bearing 440 and the second bearing 450 are seated in order to further increase the cooling performance of the motor 400.

First, describing the structure of the motor 400, the motor 400 is configured to include the stator 410, the rotational shaft 420, the rotator 430, the first bearing 440, the second bearing 450, a supporting member 460, and a cap 470.

The stator 410 is formed in a hollow shape in a shaft direction.

The rotational shaft 420 is formed to penetrate through the stator 410 and one side thereof is connected to the impeller 200.

The rotator 430 is integrally formed on the outer peripheral surface of the center of the rotational shaft 420 and is positioned to be spaced by a predetermined distance from the stator 410.

The first bearing 440 is formed on one side of the rotational shaft 420 to support the rotation of the rotational shaft 420 when the rotator 430 rotates and is provided in one side thereof connected to the impeller 200.

In other words, at one side of the rotational shaft 420, which is the right portion in FIG. 4, the first bearing 440 is positioned in the motor case 300 and the impeller 200 is positioned at the outer side thereof. (The first bearing 440 and the impeller 200 are disposed in a direction from left to right).

The first bearing 440 is formed to contact a predetermined area in the motor case 300 and the first air flowing part is formed in the motor case 300 contacting the first bearing 440 to flow air along the rotational shaft 420.

The first air flowing part is configured to include the first air flowing groove 301 concavely formed in the motor case 300 and the first air flowing groove 301 is formed in at least one along the circumference of the first bearing 440.

In this configuration, the first air flowing groove 301 is additionally formed in parallel with the rotational shaft 420 or the circumference of the rotational shaft 420 may be formed in a spiral shape but may also be variously formed.

The first air flowing grooves 301 have a structure where some of the compressed air formed by the impeller 200 flows around the first bearing 440 to cool the first bearing 440. In the motor case 300, the plurality of first air flowing grooves 301 may be formed in the area contacting the outer peripheral surface of the first bearing 440.

In other words, the first air flowing grooves 301 flow some of the air compressed by the impeller 200 into the vicinity of the first bearing 440 to cool the first bearing 400 and flows the other compressed air in the motor case 300 to cool components, such as the rotational shaft 420, the rotator 430, the stator 410, or the like, which configures the motor 400.

The second bearing 450 is to support the rotational shaft 420 such as the first bearing 440 and is provided at the other side of the rotational shaft 420.

Figure 5:
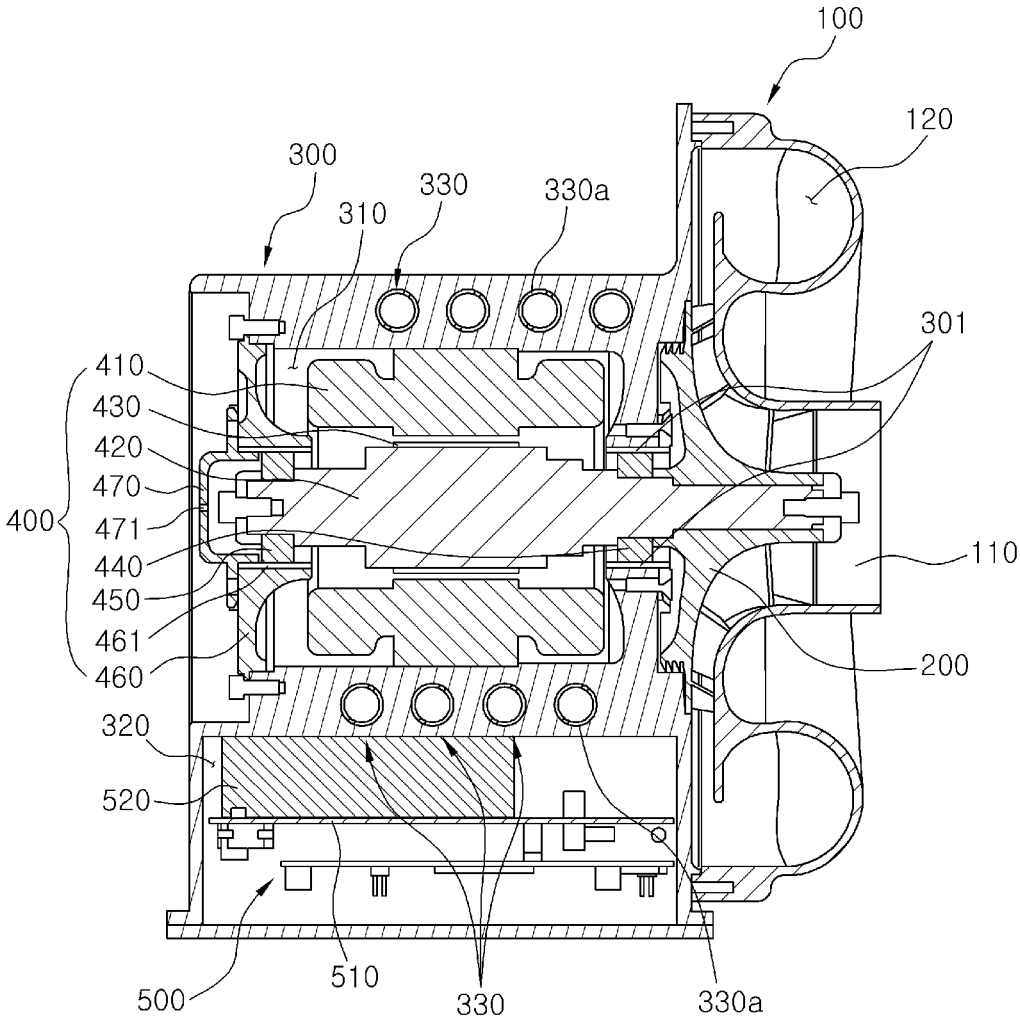
FIGS. 5 to 7 are another cross-sectional view and a left plan view of the air blower for a fuel cell vehicle according to the present invention and a diagram showing a flow of compressed air.

In this case, in the motor case 300, the other side (left in FIG. 5) that is not connected to the volute case 100 in the portion of the motor receiving part 310 is formed in a hollow shape to facilitate the mounting of the motor 400 and is formed to be fixed by the supporting member 460 and the cap 470.

The supporting member 460 is a plate-shaped member and is fixed to the motor case 300 and the central portion of the supporting member 460 has a hollow shape so that the rotational shaft 420 including the second bearing 450 is inserted thereinto.

The supporting member 460 is formed to correspond to the inner peripheral area of the hollow area to the circumference of the second bearing 450, thereby supporting the second bearing 450 and the rotational shaft 420.

Further, the cap 470 is a structure fixed to the supporting member 460 to surround the rotational shaft 420 protruded to penetrate through the supporting member 460, thereby preventing foreign materials from being introduced into the rotational shaft 420.

In the air blower 1000 for a fuel cell vehicle of the present invention, similar to the case where the first air flowing part is formed in a portion including the first bearing 440, the second air flowing part in parallel with the rotational shaft 420 is formed in the supporting member 460 including the second bearing 450.

The second air flowing part is formed in the second air flowing groove 461 concavely formed in the supporting member 460 and the second air flowing groove 461 is formed in at least one along the circumference of the second bearing 450.

The compressed air moved through the second air flowing grooves 461 is discharged to the outside through a communicating hole 471 formed in the cap 470.

Figure 6:
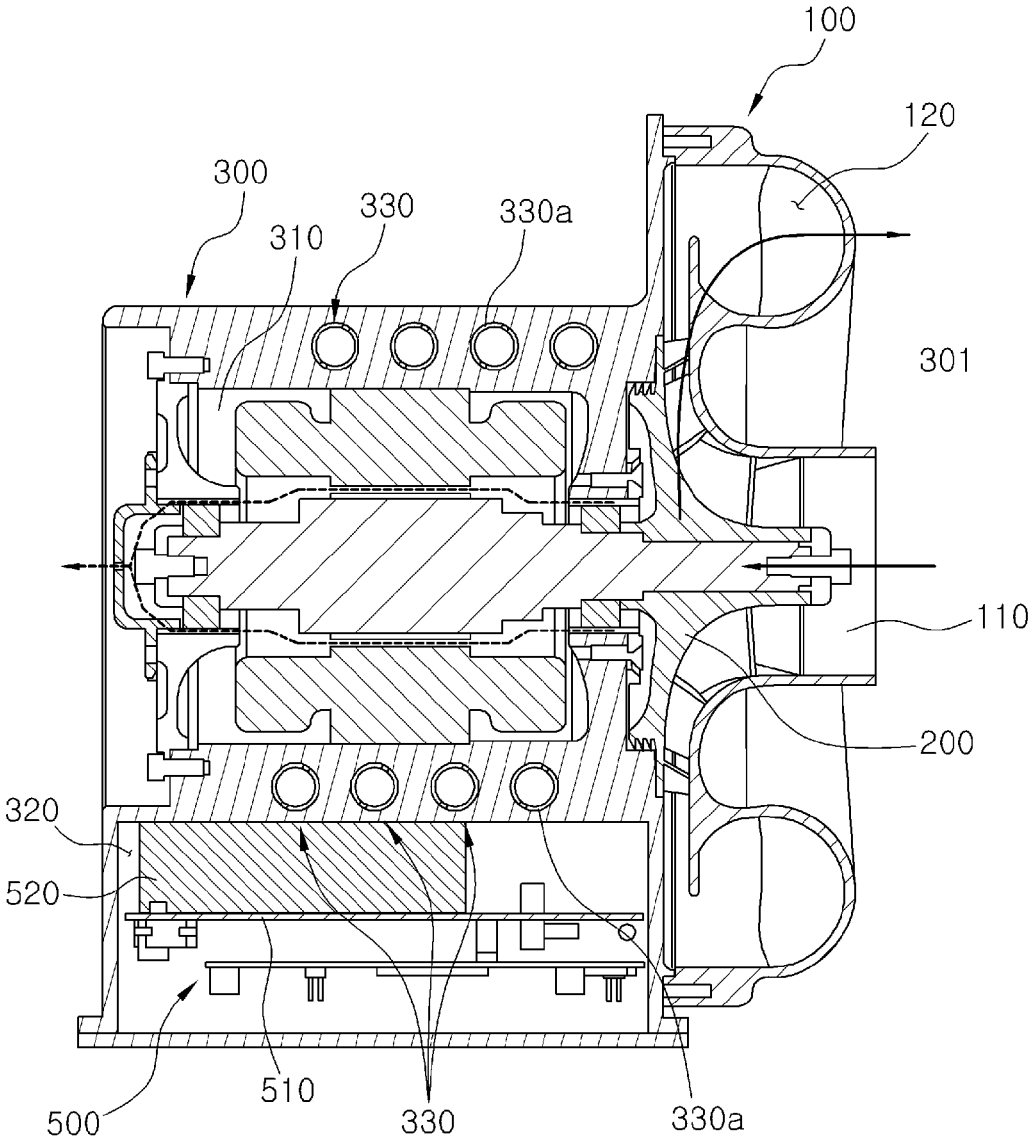
Figure 7:
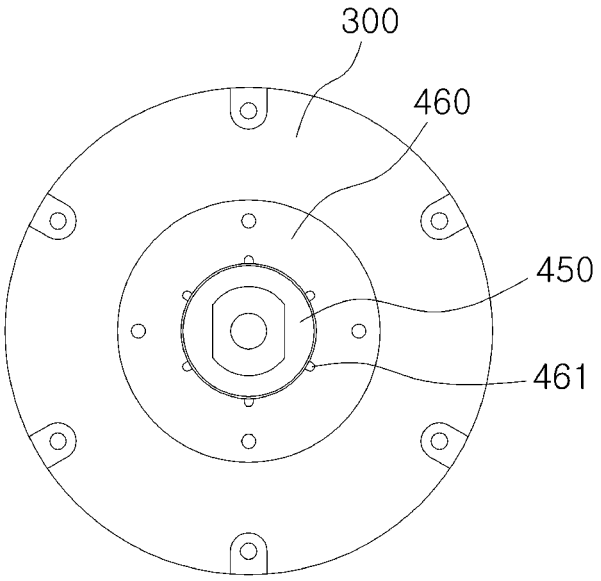

In other words, some of the compressed air formed by the impeller 200 is discharged through the first air flowing grooves 301, the area between the rotator 430 and the stator 410, the second flowing groove 461, and the communicating hole 471. (See a dotted arrow of FIG. 6.).

Some of the air discharged through air flowing grooves 301 and 461 is by a component offsetting the shaft load therein and the main flow of air discharged to the air inlet 120 is by rotation of the impeller 200.

Each component of the adjacently disposed motor 400 is cooled by the flowing of air, such that the air blower 1000 for a fuel cell vehicle of the present invention increases the durability and the use lifespan thereof is increased.

Meanwhile, when the impeller 200 is rotated by rotating the rotational shaft 420, a difference occurs between the pressure in the motor 400 and the pressure of the air inlet 110 in order to induce the shaft load in a direction from left to right in the figure. The shaft load due to the pressure difference is the main factor of degrading the internal durability.

In the air blower 1000 for a fuel cell vehicle of the present invention, the motor case 300 and the supporting member 460 are each provided with the first air flowing grooves 301 and the second air flowing grooves 461 to discharge the compressed air between the impeller 200 and the first bearing 440 in the other direction in which the impeller 200 is not provided, thereby making it possible to reduce the shaft load.

In addition, the first air flowing grooves 301 and the second air flowing grooves 461 may be variously formed in terms of number or size according to the required cooling performance or the reduced degree of the shaft load.

In other words, the air blower 1000 of a fuel cell vehicle of the present invention uses a structure where the first air flowing grooves 301 are formed in a predetermined area of the motor case 300 contacting the outer peripheral surface of the first bearing 440 and the second air flowing grooves 461 are formed in the supporting member 460 contacting the outer peripheral surface of the second bearing 450, thereby making it possible to effectively cool the inside of the motor 400 and reducing the shaft load to remarkably improve the durability.

Therefore, the air blower 1000 for a fuel cell vehicle can cool the motor 400 by forming the cooling water passage 330 and forming air flowing grooves 461 and 301 in the area contacting the bearings 440 and 450, and reduce the shaft load by the air flow of air flowing grooves 461 and 301 to improve the durability.

Further, the air blower 1000 for a fuel cell vehicle of the present invention forms the cooling water passage 330, through which the cooling water flows, in the motor case 300 to uniformly cool the entire motor 400, thereby making it possible to further increase the cooling efficiency.

The present invention is not limited to the embodiment described herein and it should be understood that the present invention may be modified and changed in various ways without departing from the spirit and the scope of the present invention. Therefore, it should be appreciated that the modifications and changes are included in the claims of the present invention.

The invention claimed is:

1. An air blower for a fuel cell vehicle, comprising:
a volute case;
an impeller equipped in the volute case to compress air;
a motor case connected to the volute case and having a motor receiving part formed therein;
a motor provided in the motor case, wherein the motor comprises:
a stator,
a rotational shaft extendedly formed in a longitudinal direction, the rotational shaft configured to penetrate through the stator and to connected to the impeller on a first side of the rotational shaft,
a rotator formed at an outer peripheral surface of a center of the rotational shaft,
a first bearing provided on the first side of the rotational shaft,
a second bearing provided on a second side of the rotational shaft opposite the first side,
a supporting member fixed to the motor case and having the second side of the rotational shaft, at which the second bearing is provided, inserted into a central area of the supporting member, and
a cap fixed to the supporting member to surround the second side of the rotational shaft;
a first air flowing part and a second air flowing part in a motor case contacting the first bearing and the supporting member contacting the second bearing to flow air along the rotational shaft,
wherein the first air flowing part and the second air flowing part each include a first air flowing groove concavely formed in the motor case and a second air flowing groove concavely formed in the supporting member, the first air flowing groove is formed along a circumference of the first bearing, and the second air flowing groove is formed along a circumference of the second bearing; and
a cooling water passage communicated along the circumference of the motor in the motor case and having cooling water flowing therein,
wherein the cooling water passage is a pipe connected in a spiral shape along the circumference of the motor receiving part, and
wherein the cap comprises a hollow communicating hole, and air compressed by the impeller is configured to be discharged to an outside of the air blower through the first air flowing groove, an area between the rotator and the stator, and the second air flowing groove and the communicating hole.

2. The air blower for a fuel cell vehicle of claim 1, wherein the inside of the motor case is provided with a module receiving part in which an inverter control module is separately provided from the motor receiving part and the cooling water passage is formed between the motor receiving part and the module receiving part.

3. The air blower for a fuel cell vehicle of claim 1, wherein the cooling water passage communicates with an inlet pipe into which the cooling water is introduced and an outlet pipe from which the cooling water is discharged at one side of the motor case.

4. The air blower for a fuel cell vehicle of claim 1, wherein the motor case is made of a material having high heat conductivity in one body.

5. The air blower for a fuel cell vehicle of claim 1, wherein the cooling water passage is made of a material having high corrosion resistance and high heat conductivity.

6. An air blower for a fuel cell vehicle, comprising:
a volute case;
an impeller equipped in the volute case configured to compress air;
a motor case connected to the volute case and having a motor receiving part formed therein;
a motor provided in the motor case, wherein the motor comprises:
a stator,
a rotational shaft extendedly formed in a longitudinal direction, the rotational shaft configured to penetrate through the stator and to connected to the impeller on a first side of the rotational shaft, a rotator formed at an outer peripheral surface of a center of the rotational shaft, a first bearing provided on the first side of the rotational shaft, a second bearing provided on a second side of the rotational shaft opposite the first side, a supporting member fixed to the motor case and having the second side of the rotational shaft, at which the second bearing is provided, inserted into a central area of the supporting member, and a cap fixed to the supporting member to surround the second side of the rotational shaft;

a first air flowing part and a second air flowing part formed in a motor case contacting the first bearing and the supporting member contacting the second bearing to flow air along the rotational shaft, wherein the first air flowing part and the second air flowing part each include a first air flowing groove concavely formed in the motor case and a second air flowing groove concavely formed in the supporting member, the first air flowing groove is formed along a circumference of the first bearing, and the second air flowing groove is formed along a circumference of the second bearing;

a cooling water passage communicated along the circumference of the motor in the motor case and configured to have cooling water flowing therein, wherein the cooling water passage is formed in a cylindrical shape surrounding the circumference of the motor receiving part, and a wall of the cylindrical shape separates an interior of the cooling water passage from the motor case, wherein the cap is provided with a hollow communicating hole, and some air compressed by the impeller is configured to be discharged to an outside of the air blower through the first air flowing groove, an area between the rotator and the stator, and the second air flowing groove and the communicating hole.

7. The air blower for a fuel cell vehicle of claim 6, wherein the cooling water passage is provided with a pin further formed therein.

8. The air blower for a fuel cell vehicle of claim 6, wherein the motor case is made of a material having high heat conductivity in one body.

9. The air blower for a fuel cell vehicle of claim 6, wherein the cooling water passage is made of a material having high corrosion resistance and high heat conductivity.

* * * * *